US006394846B1

(12) United States Patent
Belopolsky et al.

(10) Patent No.: US 6,394,846 B1
(45) Date of Patent: May 28, 2002

(54) ELECTRICAL CONNECTOR WITH SEPARATE RECEPTACLES USING COMMON FILTER

(75) Inventors: Yakov Belopolsky, Harrisburg; Robert E. MacMullin, Wellsville, both of PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/631,391

(22) Filed: Aug. 3, 2000

Related U.S. Application Data

(60) Provisional application No. 60/147,830, filed on Aug. 6, 1999.

(51) Int. Cl.[7] ..... H01R 13/66
(52) U.S. Cl. ..... 439/620; 439/607; 439/609
(58) Field of Search ..... 439/620, 607, 439/609, 610, 608

(56) References Cited

U.S. PATENT DOCUMENTS

| | | | | |
|---|---|---|---|---|
| 4,959,626 A | | 9/1990 | Mouissie | 333/182 |
| 5,073,130 A | | 12/1991 | Nakamura | 439/607 |
| 5,151,054 A | | 9/1992 | Briones et al. | 439/620 |
| 5,224,878 A | | 7/1993 | Lurie et al. | 439/620 |
| 5,257,950 A | | 11/1993 | Lenker et al. | 439/620 |
| 5,286,221 A | | 2/1994 | Fencl et al. | 439/607 |
| 5,331,505 A | | 7/1994 | Wilheim | 361/306.3 |
| 5,344,342 A | | 9/1994 | Briones | 439/620 |
| 5,397,250 A | | 3/1995 | Briones | 439/620 |
| 5,407,366 A | | 4/1995 | Briones et al. | 439/639 |
| 5,587,884 A | | 12/1996 | Raman | 361/728 |
| 5,624,277 A | | 4/1997 | Ward | 439/620 |
| 5,655,932 A | | 8/1997 | Breitschaft et al. | 439/620 |
| 5,685,739 A | * | 11/1997 | Davis et al. | 439/607 |
| 5,755,595 A | | 5/1998 | Davis et al. | 439/607 |
| 5,766,043 A | | 6/1998 | Talend | 439/676 |

FOREIGN PATENT DOCUMENTS

| | | |
|---|---|---|
| EP | 0 439 147 A1 | 1/1991 |
| EP | 0 467 400 A1 | 7/1991 |

OTHER PUBLICATIONS

Curwen, et al., "Gearing Up For USB", *Connector Specifier, Oct. Issue*, ©1998.

U.S. application No. 60/147,830, Belopolsky et al., filed Aug. 6, 1999.

* cited by examiner

*Primary Examiner*—Paula Bradley
*Assistant Examiner*—Truc Nguyen
(74) *Attorney, Agent, or Firm*—Woodcock Washburn LLP

(57) ABSTRACT

An electrical connector system having a housing including a plurality of receiving spaces each adapted to receive a complementary electrical connector. The electrical connector system includes a plurality of contacts arranged in groups corresponding to a respective one of the receiving spaces and a common filter element connected to contacts in each of the groups. The connector also includes an outer shield that generally surrounds the housing and grounding contacts to create an electrical connection between the conductive outer shield and the plug element when inserted therein. The filter element a capacitive filter and defines transverse apertures to receive the contacts. The filter includes a first conductive layer surrounding at least one of the apertures to engage a contact and forming a first electrode, a second conductive layer surrounding at least another one of the apertures to engage a contact and forming a second electrode, and a dielectric layer separating the first and second electrodes. The electrical connector system may be configured as a double-deck receptacle and adapted for mounting to a printed circuit board.

31 Claims, 7 Drawing Sheets

FIG. 5
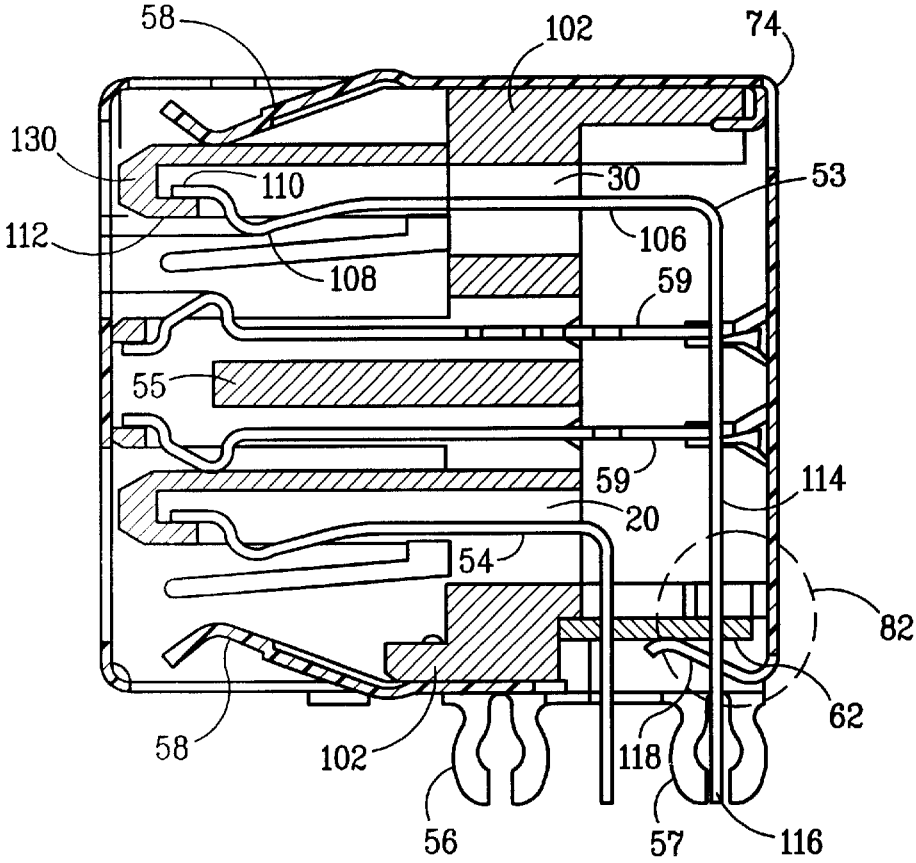
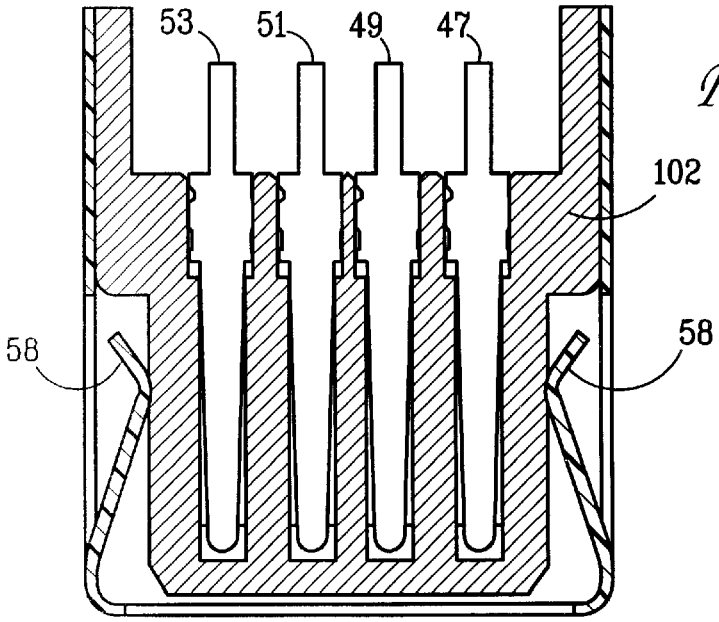
FIG. 6

FIG. 7
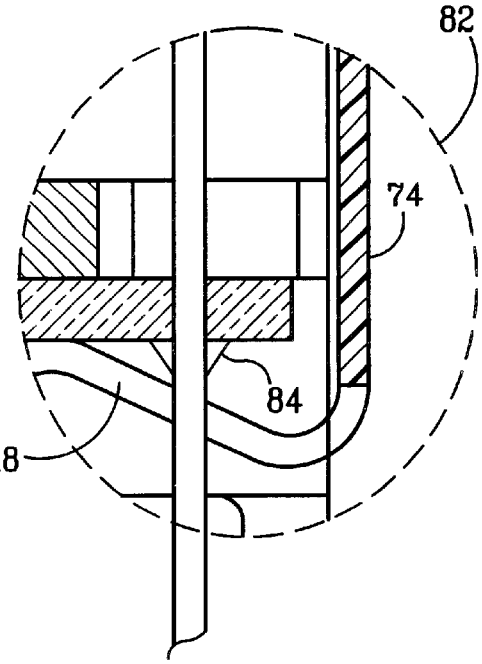
FIG. 8
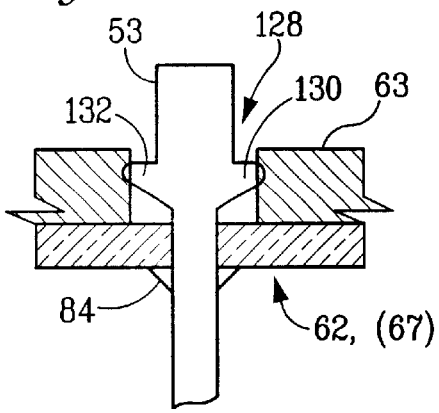
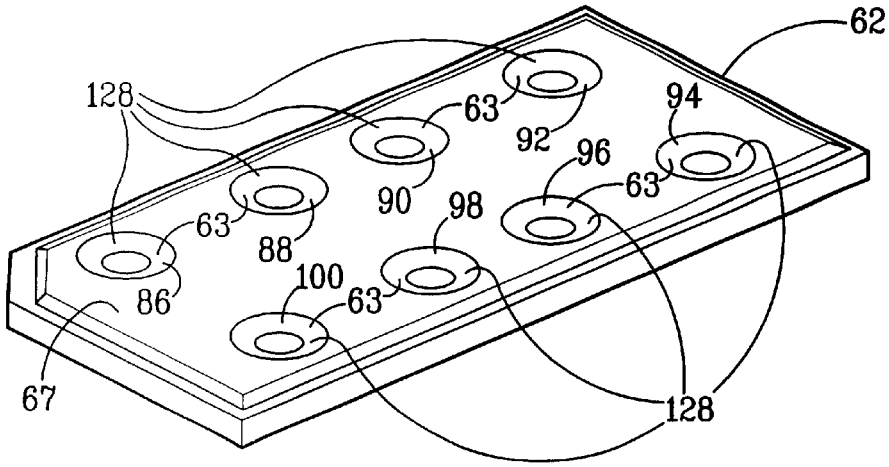
FIG. 9

FIG. 10
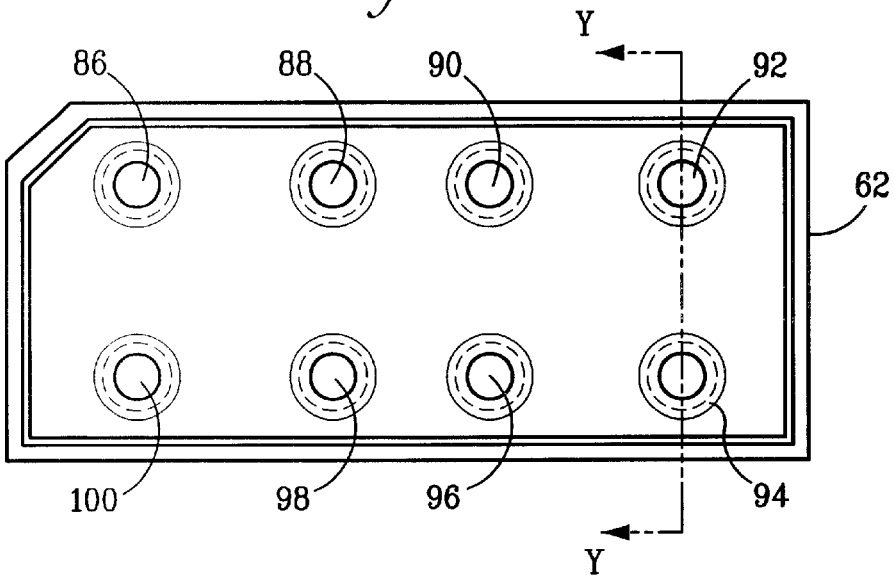
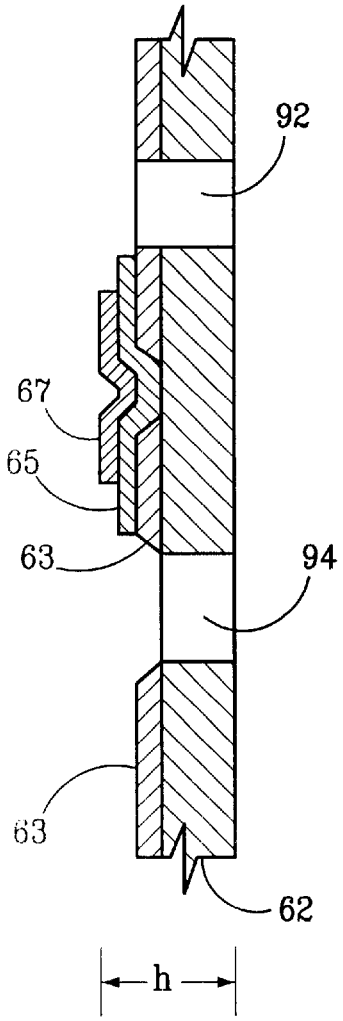
FIG. 11

ELECTRICAL CONNECTOR WITH SEPARATE RECEPTACLES USING COMMON FILTER

CROSS-REFERENCE TO RELATED APPLICATIONS

This application claims priority under 35 U.S.C. § 119(e) to U.S. Provisional Patent Application Ser. No. 60/147,830, entitled "Double-deck Filtered Universal Serial Bus Receptacle," which was filed on Aug. 06, 1999 and is hereby incorporated by reference in its entirety.

FIELD OF THE INVENTION

The present invention relates to electrical connectors and, more particularly, to receptacles which are adapted to be mounted on a printed wiring board (PWB).

BACKGROUND OF THE INVENTION

Receptacles which are adapted to be mounted on a PWB are well known in the art. The universal serial bus (USB) receptacle, for example, is used in many computer and computer peripheral applications to provide for easy connection of the peripherals to computer devices. The USB connection is expected to become increasingly popular as it provides for numerous connections to the computer device without exhausting limited computer device resources. In addition, the USB connector is an excellent solution for attaching peripheral devices to portable computing devices such as notebooks. Accordingly, many computers now include two or more USB receptacles.

In the USB there is essentially an insulative member which houses a plurality of contacts which extend horizontally then vertically to engage the PWB. A conductive shield has an upper wall which is superimposed over the horizontal section of the insulated insert. The conductive shield also has a lower wall adjacent the PWB, and the upper and lower walls are connected with the vertical side walls to form a plug receiving cavity.

Because computing devices are becoming ever smaller, a limitation of the USB connector arises from the requirement that the USB receptacle meet specified dimensions. Conventional USB receptacles disadvantageously require a relatively large amount of space as compared to the overall dimensions of new, small computing devices. Another disadvantage of such receptacles is that they may not provide a filtering element.

Thus, in view of the above, there is a need for a higher density receptacle having an integral filtering element which is adapted to be mounted to a PWB.

SUMMARY OF THE INVENTION

The present invention is directed to an electrical connector system having a housing including a plurality of receiving spaces each adapted to receive a complementary electrical connector. The electrical connector system includes a plurality of contacts arranged in groups corresponding to a respective one of the receiving spaces and a common filter element connected to contacts in each of the groups. The connector also includes an outer shield that generally surrounds the housing and grounding contacts to create an electrical connection between the conductive outer shield and the plug element when inserted therein. The filter element is a capacitive filter and defines transverse apertures to receive the contacts. The filter includes a first conductive layer surrounding at least one of the apertures to engage a contact and forming a first electrode, a second conductive surrounding at least another one of said apertures to engage a contact and forming a second electrode, and a dielectric layer separating the first and second electrodes. In accordance with a feature of the invention, the electrical connector system may be configured as a double-deck receptacle.

BRIEF DESCRIPTION OF THE DRAWINGS

The foregoing summary, as well as the following detailed description of the preferred embodiments, is better understood when read in conjunction with the appended drawings. For the purpose of illustrating the invention, there is shown in the drawings an embodiment that is presently preferred, in which like reference numerals represent similar parts throughout the several views of the drawings, it being understood, however, that the invention is not limited to the specific methods and instrumentalities disclosed. In the drawings:

FIG. 5 is a cross sectional view through X—X in FIG. 1;

FIG. 6 is a cross sectional view through U—U in FIG. 1;

FIG. 7 is a cut away view of a portion of FIG. 5;

FIG. 8 is a cut away view of FIG. 7;

FIG. 9 is a perspective view of a capacitive filter in accordance with the present invention;

FIG. 10 is a top view of the capacitive filter shown in FIG. 9;

FIG. 11 is a cross sectional view through Y—Y of FIG. 10;

DETAILED DESCRIPTION OF THE PREFERRED EMBODIMENTS

Figure 1:
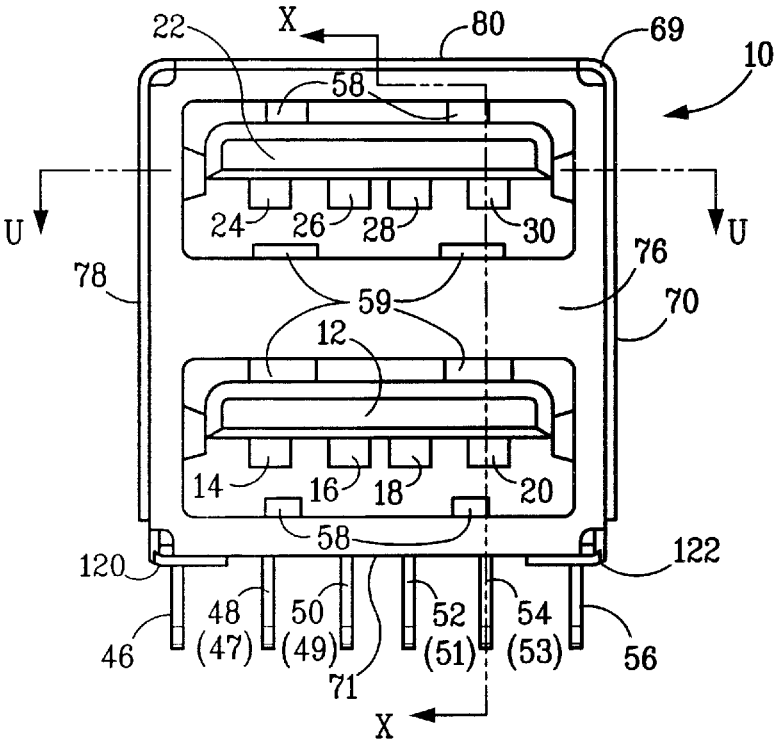
FIG. 1 is a front elevational view of a preferred embodiment of the receptacle of the present invention.
Figure 2:
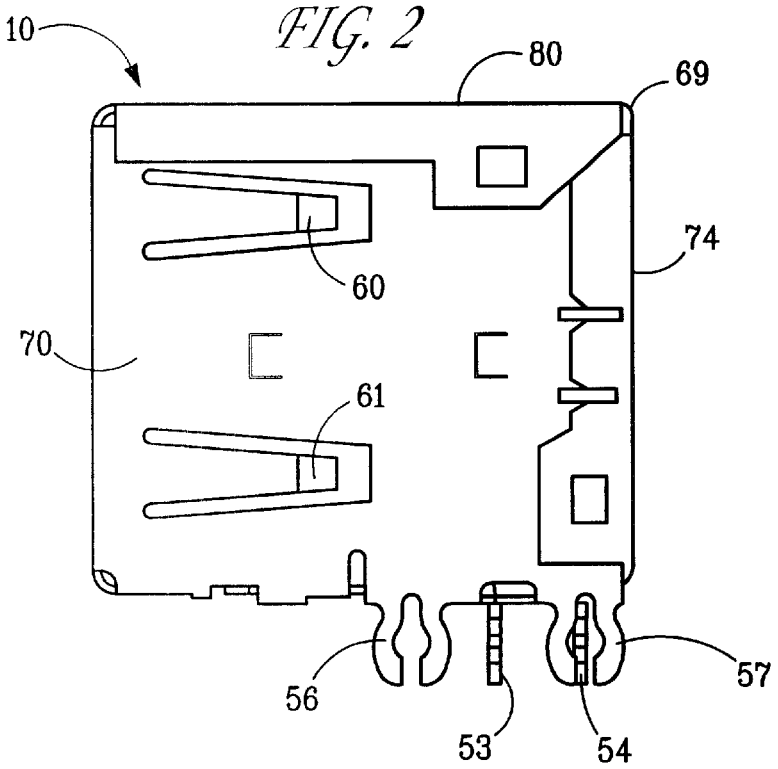
FIG. 2 is a side elevational view of the receptacle shown in FIG. 1.
Figure 3:
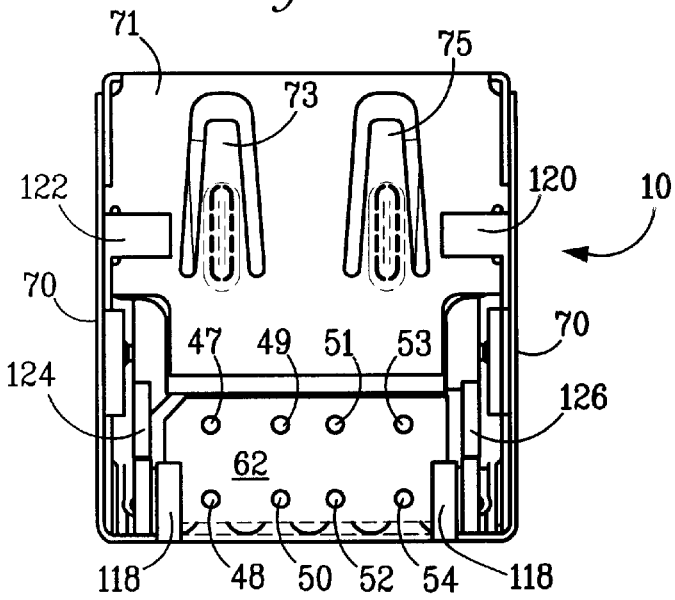
FIG. 3 is a bottom plan view of the receptacle shown in FIG. 1.

While the drawings display a double-deck receptacle 10, the present invention could be used on any type of electrical connector. As shown in FIGS. 1–5, double-deck receptacle 10 includes a conductive shield 69. Preferably from a single sheet of material, shield 69 includes a front wall 76, a top wall 80, a bottom wall 71, opposed lateral walls 70 and 78, and a rear wall 74. Front wall 76 defines a plurality of receiving spaces 12 and 22 each of which can receive a plug (not shown). Opposed lateral walls 70 and 78 each have longitudinal springs 60 and 61 bent so as to extend into the plug opening to bear against a corresponding shield (not shown) on the plug. Bottom wall 71 also includes longitudinal springs 73 and 75 that bear against the plug shield for the same purpose. Conductive shield 69 is equipped with tabs 120 and 122 that are used to secure shield 69 on an insulative housing 102. Tabs 120 and 122 also act as stand-offs to position 10 relative to a PWB (not shown). Ribs 124 and 126 also are provided on insulative housing 102. Hold downs 46, 56 and 57 aid in mounting and positioning 10 with respect to the PWB (not shown). Ground springs 118, which are formed at a lower edge of rear shield 74 and extend inwardly from rear shield 74 act to retain shield 69 on 10.

As illustrated in FIGS. 1 and 5, grounding contacts 58 and 59 are provided as a mechanism to create an electrical connection between conductive shield 69 of 10 and the shielding of a plug (not shown) when inserted therein. Grounding contacts 58 are formed from conductive shield 69, while grounding contacts 59 are formed separately from conductive shield 69. Grounding contacts 58 and 59 provide multiple paths to ground and thus reduce electromagnetic interference, while also providing a mechanical force to retain a plug inserted into 10. Grounding contacts 58 and 59 may be created from different types of materials.

As shown in FIGS. 5 and 6, insulative housing 102 has a rear section with flanges that extend horizontally therefrom. The upper and lower flanges include front edges 129 and 130. The upper and lower flanges carry contacts and have longitudinal contact receiving slots 14, 16, 18 and 20, and 24,26,28 and 30, respectively. Contacts 47–54 are disposed within the receiving slots, and may be signal contacts, a power signal, or a ground contact in accordance with a particular application. For example, contacts 47,49 and 51, and 48,50 and 52, which are inserted in contact receiving slots 24,26 and 28, and 14, 16 and 18, respectively, could be signal contacts. Contacts 53 and 54, which are inserted in contact receiving slots 30 and 20, respectively, could be ground contacts. Also as illustrated in FIG. 5, a middle flange 55 extends from insulative housing 102.

Referring particularly to FIG. 5, the contacts each include a first horizontal section 106 which has a forward terminal end 110 that is engaged by a front contact retaining lip 112. This front section also includes a convex bend 108 which extends beneath the contact receiving slot. The signal contacts also include a second vertical section 114 which extends downwardly to a PWB engagement end 116. A capacitive filter element made using known techniques is shown generally at reference numeral 62. Capacitive filter 62 could be, for example, a thick-film capacitor. FIG. 5 also illustrates a region 82, which will be discussed in greater detail with reference to FIGS. 7 and 8.

Figure 16:
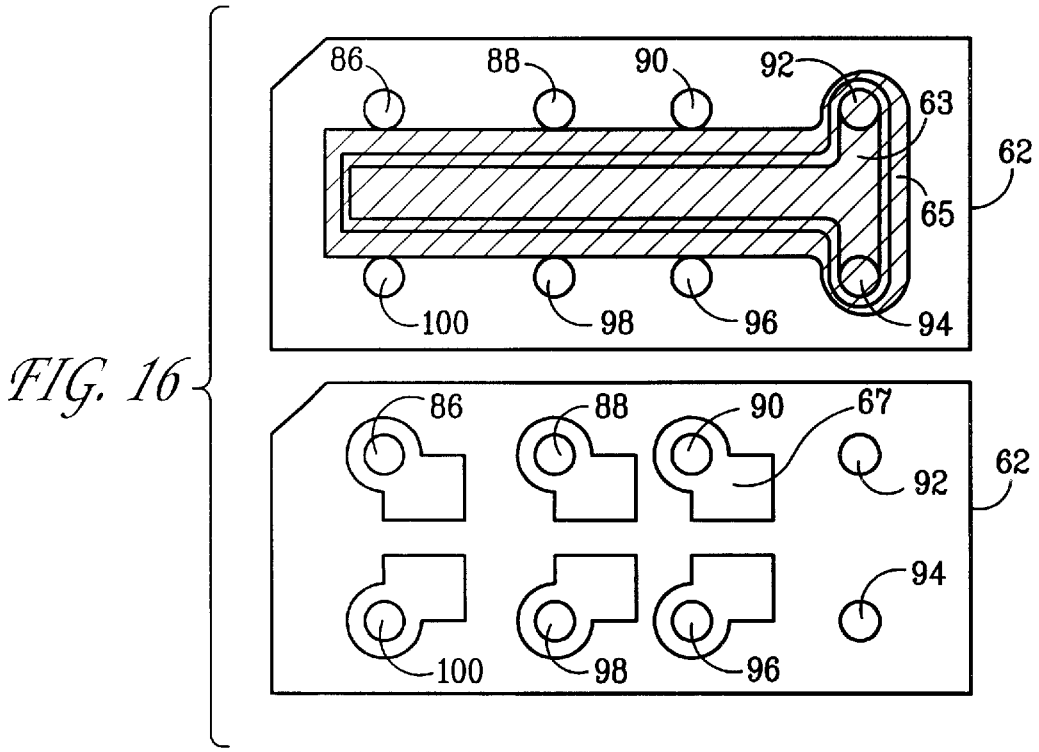
FIG. 16 is a top view of the capacitive filter further illustrating conductive and dielectric layers disposed thereon.

As illustrated in FIGS. 9 and 10, capacitive filter element 62 has transverse apertures 86,88,90,92,94,96,98 and 100 and is preferably made from a ceramic, such as $Al_2O_3$ or ferrite. As shown in FIGS. 11 and 16, a conductive layer 63, which is metallic (e.g., PdAg) extends across filter elements and surrounds apertures 92 and 94. Conductive layer 63 acts as the bottom electrode of the capacitor. Formed on conductive layer 63, is a dielectric layer 65. Formed on the dielectric layer 65 is another conductive layer 67. Layer 67 is not continuous. Rather, layer 67 has individual regions that surround one of apertures 86,88,90,96,98 and 100 (i.e., the apertures through which the signal contacts noted above pass). Conductive layer 67 also is metallic (e.g., PdAg). The individual regions of conductive layer 67 form the top electrodes of several capacitors. In accordance with the present invention, the combination of conductive layer 63, dielectric layer 65 and each electrode of conductive layer 67 forms a capacitor at each of apertures 86,88,90,96,98 and 100, which filters the signal passing through a respective signal contact.

As illustrated in FIGS. 9 and 11, conductive layer 63, dielectric layer 65 and the electrodes formed by conductive layer 67 are deposited such that recessed regions 128 are formed. Recessed regions 128 surround the apertures in order to expose a selected one of the conductive layers 63 and 67. This feature will now be described in detail with reference to FIGS. 7 and 8 where region 82 of FIG. 5 is illustrated.

As shown in FIGS. 7 and 8, region 82 illustrates the connection between a representative ground contact 53 and capacitive filter 62. Contact 53 has a generally "Y" shaped region formed near a terminal end. The top portion of the "Y" includes a pair of protrusions 130 and 132 that make electrical contact with conductive layer 63 in recessed region 128. The lower (vertical) portion of the "Y" is attached to electrode 67 of capacitive filter 62 by a solder joint 84. Signal contacts 48–53 (as shown in FIGS. 1–6) secure to capacitive filter 62 in a similar fashion, except contacts 48–53 engage conductive layer 67.

The use of solder joints 84 advantageously simplifies the manufacturing process of double-deck 10, because solder joints 84 hold capacitive filter 62 in place. Further, in accordance with the present invention, capacitive filter 62 is directly connected to direct current (DC) ground via contacts 53 and 54 (apertures 92 and 94). As a result, there is no need to solder capacitive filter 62 to conductive shield 69 of 10. In other words, the present invention could provide separate ground paths for contacts 53,54 and for shield 69. Alternatively, shield 69 and contacts 53 and 54 could share a common ground. Ground springs 118, which are formed at a lower edge of rear shield 74 and extend inwardly from rear shield 74 act to retain the shield on receptable 10. Preferably located away from the filter, springs 118 could bear against the edges of the capacitive filter 62 for grounding purposes.

Figure 12:
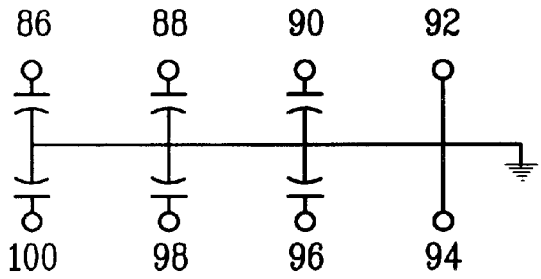
FIG. 12 is an equivalent schematic of the capacitive filter of FIGS. 9–11.
Figure 13:
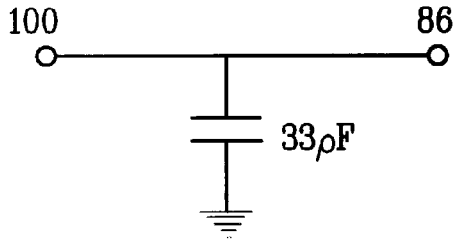
FIG. 13 is a partial schematic of an alternative embodiment of the equivalent schematic of FIG. 12.
Figure 14:
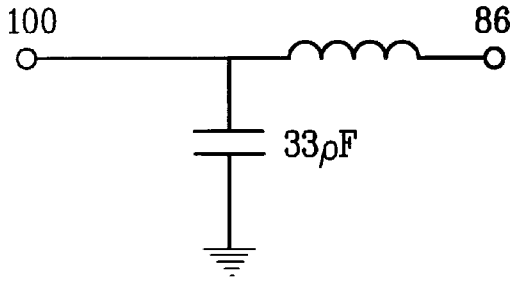
FIG. 14 is a partial schematic of another alternative embodiment illustrating an optional inductive filter.

FIG. 12 illustrates an equivalent circuit schematic of capacitive filter 62. Each of apertures 86,88,90,96,98 and 100 is coupled by the capacitor formed by the layers 63,65 and 67 to ground via apertures 92 and 94. As noted, apertures 92 and 94 are preferably connected to the ground of the DC power circuitry, which is supplied to double-deck 10 by the PWB. The capacitance values of the capacitors illustrated in FIG. 12 are shown in Table 1. FIG. 13 illustrates a partial alternate schematic showing two of the apertures 86 and 100 connected to ground by a capacitor made from ceramic. Optionally, filter 62 could be made from ferrite using know techniques to provide inductive capabilities. FIG. 14 illustrates an equivalent circuit for such an arrangement.

In accordance with the present invention, the capacitive filter 62 preferably has capacitance values within the ranges indicated in Table 1.

TABLE 1

| Capacitance, pF @ 1 kHz | | |
|---|---|---|
| Minimum Value | Nominal Value | Maximum Value |
| 24 | 33 | 42 |
| 46 | 68 | 84 |
| 88 | 120 | 152 |

Capacitive filter 62 has a characteristic impedance, as indicated in Table 2. The height (h) of capacitive filter 62 is illustrated in FIG. 11. As indicated by the results in Table 2, the height of capacitive filter 62 is preferably 2.2 mm, in order to yield advantageous characteristic impedance values.

TABLE 2

| height (h), mm | Impedance, ohm 1 MHz | 10 MHz | 100 MHz | 300 MHz | 400 MHz | 500 MHz |
|---|---|---|---|---|---|---|
| 7.7 | 2.0 | 20 | 156 | 222 | 205 | 181 |
| 5.1 | 1.2 | 12.3 | 94 | 148 | 153 | 148 |
| 4.0 | 1.0 | 10 | 78 | 120 | 127 | 128 |
| 2.2 | 0.4 | 5 | 43 | 71 | 73 | 74 |

Figure 15:
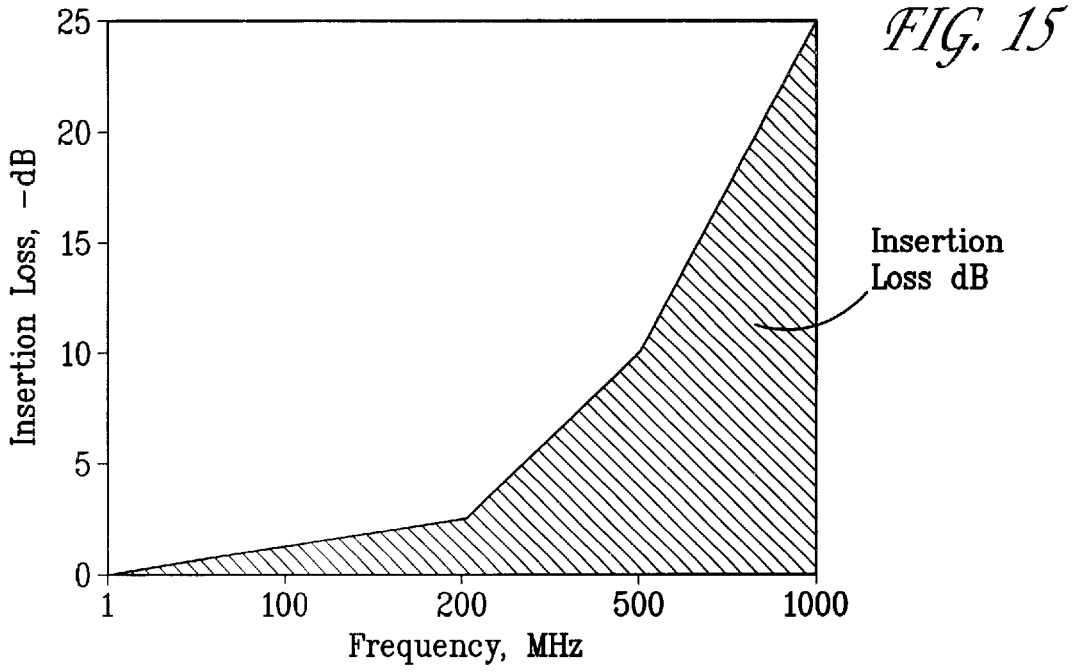
FIG. 15 is a graph of insertion loss vs. frequency of the capacitive filter.

FIG. 15 illustrates a graph of insertion loss versus frequency of the filtered receptacle of the present invention. Tables 3 and 4 below exhibit actual test results of receptacle 10 of the present invention.

TABLE 3

| Bandwidth (MHz) | Contact 47 Insertion Loss (dB) | Contact 49 Insertion Loss (dB) | Contact 52 Insertion Loss (dB) | Contact 54 Insertion Loss (dB) |
|---|---|---|---|---|
| 0.300 | 0.0265 | 0.0032 | 0.0280 | 0.028 |
| 1.000 | 0.0287 | 0.0109 | 0.026 | 0.022 |
| 3.000 | 0.038 | 0.0164 | 0.028 | 0.027 |
| 5.000 | 0.0418 | 0.0171 | 0.034 | 0.029 |
| 10.000 | 0.0580 | 0.031 | 0.048 | 0.043 |
| 25.000 | 0.0763 | 0.043 | 0.063 | 0.055 |
| 50.000 | 0.2403 | 0.163 | 0.182 | 0.188 |
| 150.000 | 1.1563 | 1.045 | 1.15 | 1.12 |
| 200.000 | 2.4564 | 2.45 | 2.64 | 2.48 |
| 300.000 | 4.7451 | 5.19 | 5.57 | 4.99 |
| 400.000 | 7.8993 | 9.34 | 9.69 | 8.36 |
| 500.000 | 8.4321 | 14.23 | 12.72 | 8.10 |
| 700.000 | 14.413 | 10.98 | 10.65 | 13.14 |
| 1000.000 | 23.240 | 32.28 | 33.18 | 24.53 |

TABLE 4

| | 1 kHz | 100 kHz |
|---|---|---|
| Contact 47 | 22–30 | 36.2 pF |
| Contact 49 | 24–29 | 34.2 pF |
| Contact 52 | 23–31 | 35.6 pF |
| Contact 54 | 22–30 | 33.3 pF |

Figure 4:
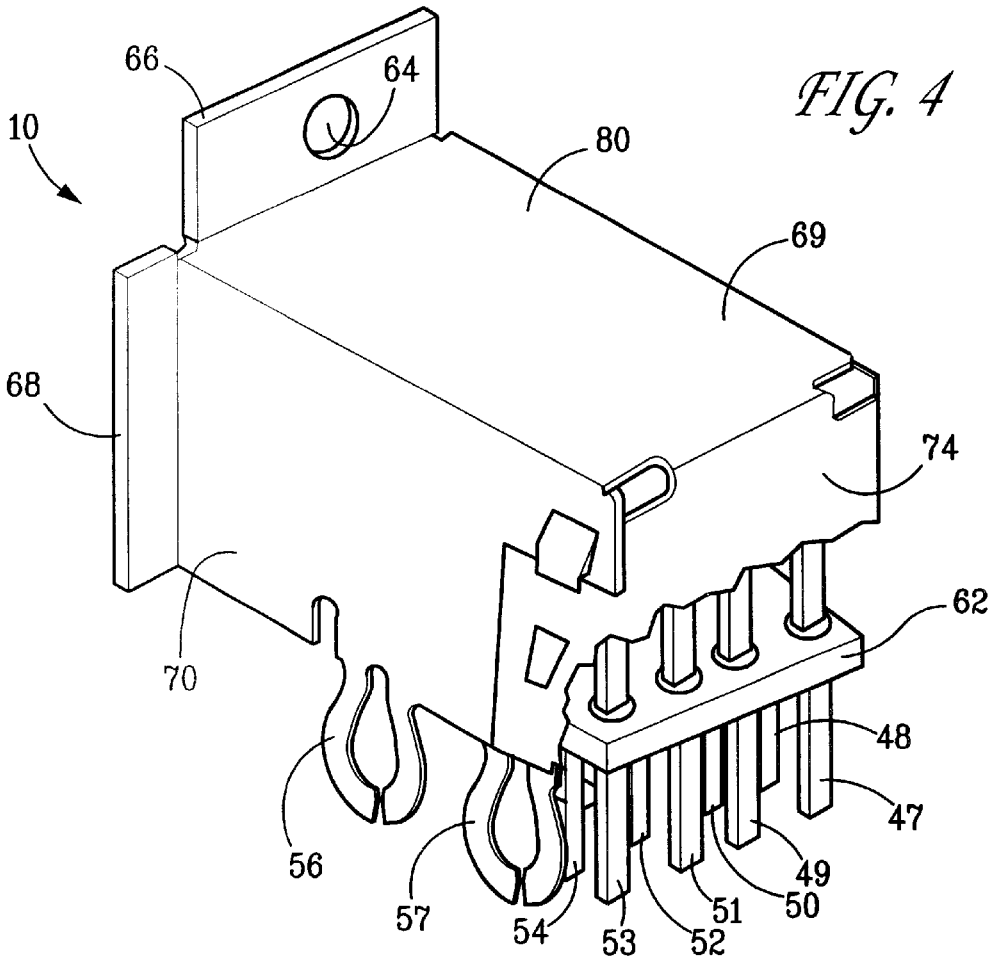
FIG. 4 is a rear perspective view of the receptacle shown in FIG. 1.

It will be appreciated that there has been described a double-deck receptacle adapted to be mounted on a PWB and to provide an integral filtering technique. While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims. For example, as shown in FIG. 4, the top wall 80 may from a front flange 66 that defines a circular aperture 64, and the opposed lateral walls 70 and 78 may form a pair of side flanges 68. The circular aperture 64 is provided to mate with a bump (not shown) that facilitates locating the receptacle on an enclosure.

What is claimed is:

1. An electrical connector system, comprising:

a housing including a plurality of receiving spaces adapted to receive a complementary electrical connector;

a plurality of contacts arranged in groups corresponding to a respective one of said receiving spaces;

a common filter element connected to contacts in each of said groups; and a shield connected to the housing, wherein the shield has a first grounding contact engages on a first side of said complementary electrical connector, and wherein the shield has a second grounding contact is facing a side of said complementary electrical connector opposite said first side;

wherein said second grounding contact is connected to said common filter element.

2. The electrical connector system as recited in claim 1, further comprising an outer shield generally surrounding said housing.

3. The electrical connector system as recited in claim 1, further comprising grounding contacts to create an electrical connection between the said conductive outer shield and said complementary electrical connector when inserted therein.

4. The electrical connector system as recited in claim 1, wherein said contacts comprise one of signal contacts, a power contact, or a ground contact, and wherein said ground contacts are connected to a direct current ground on the PWB.

5. The electrical connector system as recited in claim 1, wherein said filter element comprises a capacitive filter and defines transverse apertures to receive said contacts, and wherein said capacitive filter comprises:

a first conductive layer surrounding at least one of said apertures to engage a contact and forming a first electrode;

a second conductive layer surrounding at least another one of said apertures to engage a contact and forming a second electrode; and a dielectric layer separating said first and second electrodes.

6. The electrical connector system as recited in claim 1, wherein said capacitive filter has a nominal capacitance of 33, 68 or 120 pF.

7. The electrical connector system as recited in claim 1, wherein one of said receiving spaces is superposed over another one of said receiving spaces.

8. The electrical connector system as recited in claim 5, wherein said predetermined ones of said apertures are those through which signal contacts pass.

9. The electrical connector system as recited in claim 5, wherein said capacitive filter has a base substrate made from a ceramic.

10. The electrical connector system as recited in claim 5, wherein said capacitive filter has a base substrate made of ferrite.

11. The electrical connector system as recited in claim 5, wherein said conductive layer, said dielectric layer and said electrodes are deposited such that a recessed region is formed that surround said apertures to expose said dielectric layer, and wherein each of said contacts has a generally "Y" shaped region formed near said terminal end, and wherein said "Y" shaped region includes a pair of protrusions that make electrical contact with one of said conductive layers in said recessed region.

12. The electrical connector system as recited in claim 5, wherein said terminal end of said contacts are attached to said capacitive filter by a solder joint.

13. The electrical connector system as recited in claim 5, wherein said grounding contact connects to said first conductive layer.

14. The electrical connector system as recited in claim 12, wherein said capacitive filter is connected to direct current ground via predetermined contacts soldered to said capacitive filter.

15. A receptacle having a conductive outer shield, comprising:

a plurality of receiving spaces each adapted to receive a complementary plug structure;

a plurality of contacts disposed within predetermined ones of said receiving spaces and extending outward through said receptacle to form a terminal end for mounting to a printed wiring board;

a filter element connected to said plurality of contacts;

a first grounding contact engages on a first side of said complementary plug structure; and a second grounding contact is facing a side of said complementary electrical plug opposite said first side;

wherein said second grounding contact is connected to said common filter element.

16. The receptacle as recited in claim 15, wherein said filter element comprises a capacitive filter element defining a plurality of apertures, and wherein said capacitive filter comprises:

a first conductive layer surrounding at least one of said apertures to engage a contact and forming a first electrode;

a second conductive layer surrounding at least another one of said apertures to engage a contact and forming a second electrode; and a dielectric layer separating said first and second electrodes.

17. The receptacle as recited in claim 16, wherein said predetermined ones of said apertures are those through which signal contacts pass.

18. The receptacle as recited in claim 16, wherein said conductive layer, said dielectric layer and said electrodes are deposited such that a recessed region is formed that surround said apertures to expose said dielectric layer, and wherein each of said contacts has a generally "Y" shaped region formed near said terminal end that includes a pair of protrusions that make electrical contact with one of said conductive layers in said recessed region.

19. The receptacle as recited in claim 16, wherein said terminal end of said contacts are attached to said capacitive filter by a solder joint.

20. The receptacle as recited in claim 15, wherein said capacitive filter has a nominal capacitance of 33, 68 or 120 pF.

21. The electrical connector system as recited in claim 16, wherein said grounding contact connects to said first conductive layer.

22. A double-deck receptacle, comprising:

a conductive outer shield having a top wall, a bottom wall, a rear wall and opposed lateral wall, said top wall forming a front flange defining a circular aperture and said opposed lateral walls forming a pair side flanges;

inner insulative members that extend horizontally within said receptacle to form terminal front edges and support said conductive outer shield, said insulative members each defining longitudinal contact receiving slots;

a plurality of receiving spaces each adapted to receive a complementary plug structure;

a plurality of contacts disposed within predetermined ones of said receiving spaces and extending outward through said receptacle to form a terminal;

a capacitive element connected to said plurality of contacts; and a first grounding contact engages to said conductive outer shield on a first side of said complementary plug structure; and a second grounding contact is facing a side of said complementary electrical plug opposite said first side;

wherein said second grounding contact is connected to said common filter element.

23. The double-deck receptacle as recited in claims 22, wherein said receptacle further comprises stand-offs and hold downs for mounting and positioning said receptacle.

24. The double-deck receptacle as recited in claim 22, wherein said contacts comprise one of signal contacts, a power signal, or a ground contact, and wherein said ground contacts are connected to a direct current ground on a PWB.

25. The double-deck receptacle as recited in claim 22, wherein said capacitive filter element defines transverse apertures, and wherein said capacitive filter comprises:

a first conductive layer surrounding at least one of said apertures to engage a contact and forming a first electrode;

a second conductive layer surrounding at least another one of said apertures to engage a contact and forming a second electrode; and a dielectric layer separating said first and second electrodes.

26. The double-deck receptacle as recited in claim 25, wherein said predetermined ones of said apertures are those through which signal contacts pass.

27. The double-deck receptacle as recited in claim 25, wherein said conductive layer, said dielectric layer and said electrodes are deposited such that a recessed region is formed that surround said apertures to expose said dielectric layer, wherein each of said contacts has a generally "Y" shaped region formed near said terminal end, and wherein said "Y" shaped region includes a pair of protrusions that make electrical contact with one of said conductive layers in said recessed region.

28. The double-deck receptacle as recited in claim 25, wherein said terminal end of said contacts are attached to said capacitive filter by a solder joint.

29. The double-deck receptacle as recited in claim 25, wherein said capacitive filter is connected to direct current ground via predetermined contacts soldered to said capacitive filter.

30. The double-deck receptacle as recited in claim 25, wherein said capacitive filter has a nominal capacitance of 33, 68 or 120 pF.

31. The electrical connector system as recited in claim 23, wherein said grounding contact connects to said first conductive layer.

* * * * *